US008475232B2

(12) United States Patent
Weber et al.

(10) Patent No.: US 8,475,232 B2
(45) Date of Patent: Jul. 2, 2013

(54) GRINDING MACHINE

(75) Inventors: Markus Weber, Kronach (DE); Christian Engelhardt, Pressig (DE)

(73) Assignee: Hans Weber Maschinenfabrik GmbH, Kronach (DE)

( * ) Notice: Subject to any disclaimer, the term of this patent is extended or adjusted under 35 U.S.C. 154(b) by 355 days.

(21) Appl. No.: 12/855,987

(22) Filed: Aug. 13, 2010

(65) Prior Publication Data

US 2011/0263184 A1 Oct. 27, 2011

(30) Foreign Application Priority Data

Apr. 23, 2010 (DE) ..... 10 2010 016 606

(51) Int. Cl.
*B24B 7/00* (2006.01)

(52) U.S. Cl.
USPC ..... 451/162; 451/167; 451/168; 451/171

(58) Field of Classification Search
USPC ..... 451/41, 65, 162, 167, 168, 171
See application file for complete search history.

(56) References Cited

U.S. PATENT DOCUMENTS 2,548,979 A 4/1951 Johnson
2,854,795 A * 10/1958 McCown et al. ..... 451/41
3,263,376 A * 8/1966 Walters et al. ..... 451/41
4,878,317 A 11/1989 Ovens
4,969,296 A * 11/1990 Seki et al. ..... 451/162

FOREIGN PATENT DOCUMENTS

EP 0 543 947 B1 2/1999
GB 370269 4/1932
GB 370269 A * 4/1932
WO 92/03257 A1 3/1992

OTHER PUBLICATIONS

A Search Report from corresponding European Appln. No. 11153337.8 dated Oct. 18, 2012 (6 pages).

* cited by examiner

*Primary Examiner* — Maurina Rachuba
(74) *Attorney, Agent, or Firm* — McCormick, Pulding & Huber LLP

(57) ABSTRACT

A grinding machine includes a machine frame with a work piece support surface on which a work piece may be transporter through the machine. A grinding bar arrangement including two grinding shoes positioned in parallel is arranged transversely with respect to a work piece feeding direction across the width of the work piece support surface. The two grinding shoes carry a grinding medium on their surfaces facing the work piece support surface and are suspended via an eccentric drive. The two grinding shoes perform rotary movements in a plane parallel to the work piece support surface achieving a high quality grinding result.

3 Claims, 3 Drawing Sheets

GRINDING MACHINE

CROSS REFERENCE TO RELATED APPLICATIONS

Applicants hereby claim foreign priority benefits under 35 U.S.C. §119 of German Patent Application No. 10 2010 016 606.5 filed Apr. 23, 2010, the disclosures of which are herein incorporated by reference.

BACKGROUND OF THE INVENTION

The invention concerns a grinding machine containing a machine frame having a work piece support surface and at least one grinding bar moveably mounted on the machine frame and extending transversely across the work piece support surface which grinding bar carries a grinding medium on its surface facing the work piece support surface and which grinding bar can be driven by means of an eccentric drive in a circular movement parallel to the work piece support surface in such a way that it travels in circles parallel to itself, the eccentric drive having at least two eccentric shafts which are directed perpendicularly to the work piece support surface and which are distanced from each other in the longitudinal direction of the grinding bar.

A grinding machine of this kind is known for example from EP 543 947 B1. In the solution described therein, the grinding bar is arranged on a beam via the eccentric drive, which beam is in its turn mounted on the machine frame via a second eccentric drive. The two eccentric drives run at different speeds so that the grinding bar carries out two overlapping circular movements of different diameters and different rotary speeds. Hereby overlapping and preferably non-linear grinding marks are to be produced so as to avoid the occurrence of significantly prominent grinding marks in the grinding pattern. The overlapping eccentric drives entail a considerable complexity of the construction. Moreover there is a problem in that great overhung masses are put into a fast circular motion eccentrically and the resulting imbalance cannot be completely balanced out even with the use of counter weights. Thus the grinding machine is caused to vibrate strongly during operation.

There are also numerous solutions in which several grinding units are arranged in series so that the grinding marks produced by the grinding units overlap each other. These solutions also require very complex constructions.

SUMMARY OF THE INVENTION

It is an object of the present invention to disclose a grinding machine of the kind mentioned in the introduction which makes it possible to obtain a good grinding result with low complexity and which avoids the disadvantages mentioned above.

This object is solved according to the invention in that the grinding bar is divided into at least two parallel grinding shoes arranged side by side which grinding shoes are each driveable by an eccentric shaft of the eccentric drive, wherein the eccentricity of the eccentrics assigned to the single grinding shoes and the masses of the grinding shoes are selected such that the centrifugal forces caused by the driven grinding shoes counterbalance each other.

The solution according to the invention makes it possible to produce overlapping non-linear grinding marks with a single eccentric drive. In the most simple case the grinding bar contains two grinding shoes of equal mass wherein the eccentricities of the eccentrics assigned to the two grinding shoes are equal but displaced from one another by 180° relative to the drive axis. This arrangement guarantees a perfect mass balance. Each grinding shoe functions as a counter mass for the respective other grinding shoe so that the occurrence of vibrations due to unbalanced masses is prevented. At the same time the movement of the two grinding shoes in opposite directions causes the grinding marks produced by the abrasive grains of the two grinding shoes to overlap each other in a complex manner on the work piece surface whereby a high-quality grinding result is achieved.

According to an alternative embodiment the grinding bar has three grinding shoes of equal mass wherein the two outer ones are rigidly connected to each other for common movement and the eccentricity of the eccentrics assigned to the middle grinding shoe is twice as big as the eccentricities of the eccentrics assigned to the outer grinding shoes and displaced by 180° with regard to them. This solution provides for a complete mass balance and at the same time renders an even more complex overlapping of the grinding marks. A major advantage of the solution according to the invention is that such a grinding result is achieved with a single eccentric drive.

BRIEF DESCRIPTION OF THE DRAWINGS

Further features and advantages of the invention will become clear from the following description which, in connection with the attached drawings, explains the invention by means of an exemplary embodiment. In the drawings.

DETAILED DESCRIPTION OF THE PREFERRED EMBODIMENTS

Figure 1:
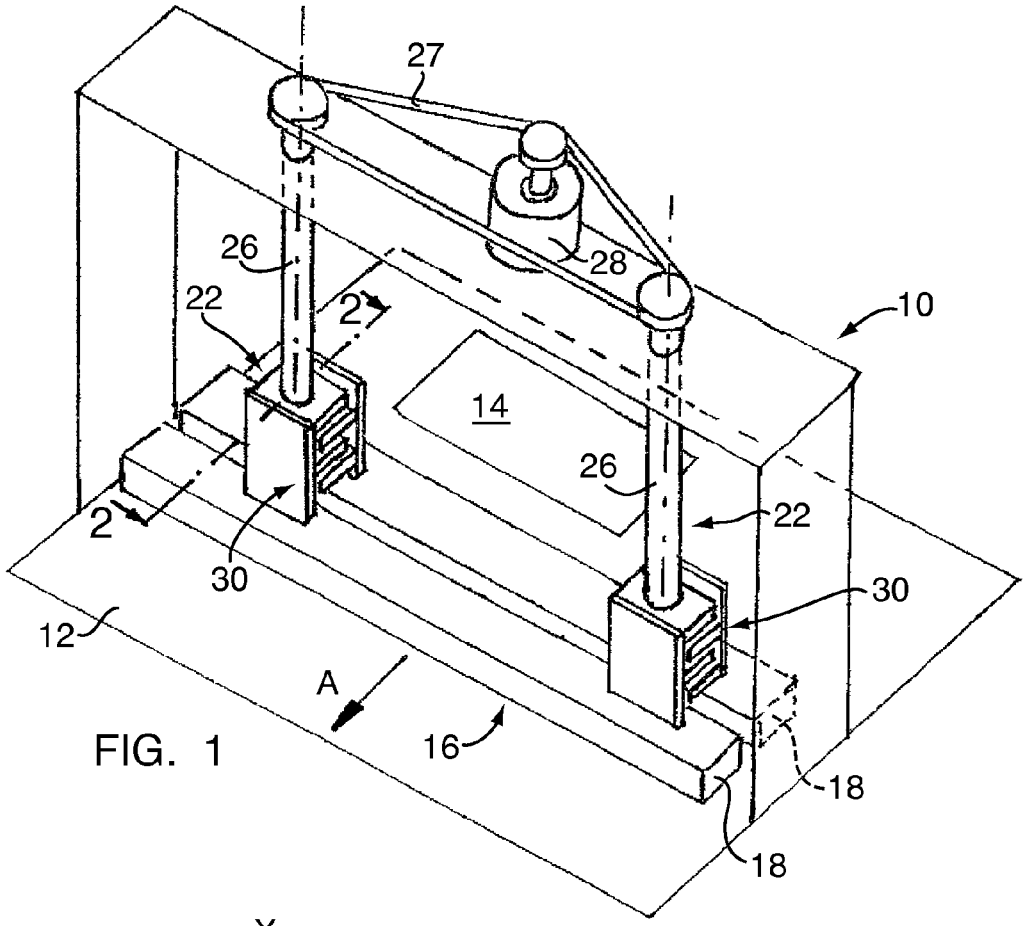
FIG. 1 shows a schematic perspective view of the grinding machine according to a first exemplary embodiment of the invention.

The grinding machine depicted schematically in FIG. 1 contains a machine frame generally denoted at 10 with a work piece support surface 12 on which a work piece 14 can be transported through the machine in the direction of the arrow A, which transport is as a rule carried out with the help of a transport arrangement not depicted in the drawing. A grinding bar arrangement 16 containing two grinding shoes 18 positioned in parallel is arranged transversely with respect to the work piece feeding direction A across the width of the work piece support surface. The two grinding shoes 18 carry a grinding medium 20 (FIG. 2) on their lower surfaces, i.e. on the surfaces facing the work piece support surface 12, and are suspended via a eccentric drive generally denoted at 22 from a portal 24 of the machine frame 10 which portal spans the work piece support surface 12. The eccentric drive 22 contains two drive shafts or eccentric shafts 26 which are driven via a belt 27 or a chain by a motor 28 and which are connected to the two grinding shoes 18 via a corresponding eccentric arrangement 30. An eccentric arrangement 30 will now be explained in more detail with reference to FIG. 2.

Figure 2:
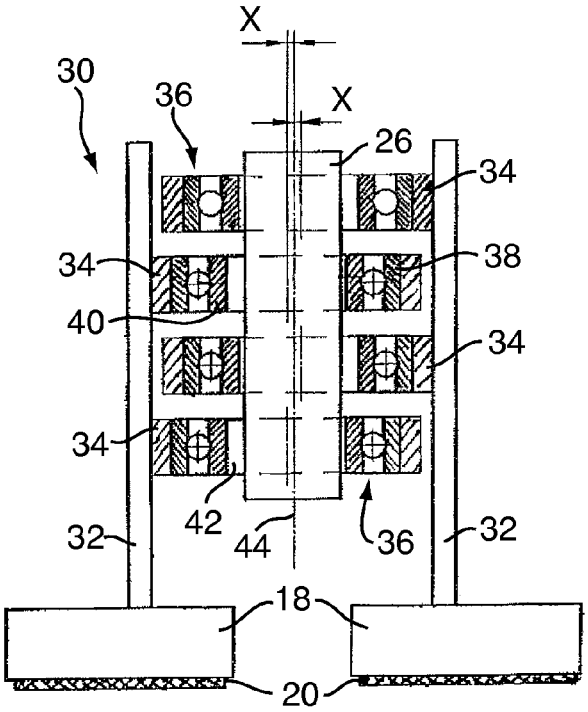
FIG. 2 shows a partial section through an eccentric arrangement along line II-II in FIG. 1, FIGS. 3 to 5 each show a schematic top view onto the two grinding shoes in the area of the eccentric arrangement for explanation of the movement of the two grinding shoes relative to each other.

Each grinding shoe 18 is connected on its upper surface to a beam 32 which in turn has two arms 34, each of which holds a ball bearing 36. The outer ball race 38 of the ball bearing is fixedly connected to the corresponding arm 34 while the inner ball race 40 is supported on an eccentric bushing 42. The eccentric bushings 42 of the ball bearings 36 which are arranged in alternating order on top of each other on the two beams 32 are interspersed by the drive shaft 26, as shown in FIG. 2. In this arrangement, the eccentric bushings 42 are arranged such that the eccentricities X of equal size of the eccentrics assigned to the two beams 32 and the two grinding shoes 18, respectively, are displaced from each other by 180° with respect to the axis 44 of the drive shaft 26. Of course, instead of an eccentric bushing 42 pressed onto the drive shaft 26 also a corresponding eccentric collar could be provided on the drive shaft 26. The eccentric support of the two grinding shoes 18 on the drive shafts 26 described above causes the grinding shoes 18 to always perform exactly the same movements in opposite directions during a rotation of the drive shafts 26 due to the fact that the eccentricities are of the same size but arranged in opposite directions, which shall now be explained with respect to FIGS. 3 to 5.

Figure 3:
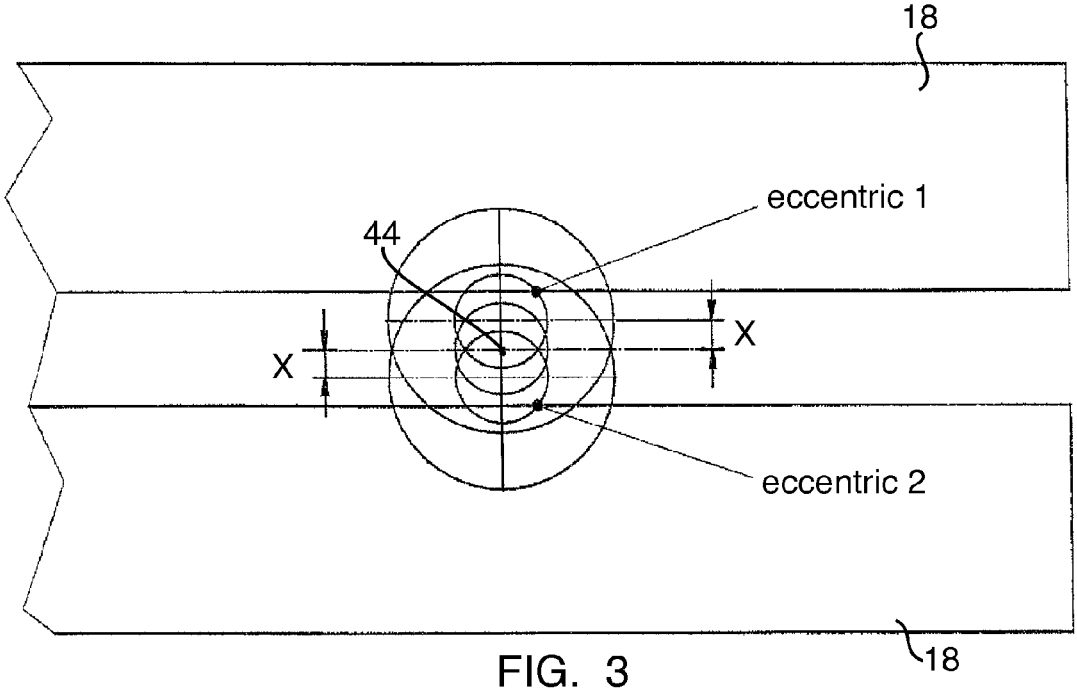

FIG. 3 depicts the two grinding shoes 18 while they are at the greatest possible distance from each other, i.e. in a position of the eccentric arrangement 30 in which the eccentricities are directed perpendicularly to the longitudinal direction of the two grinding shoes 18. The axis 44 of the drive shaft 26 connected to the two eccentrics 1 and 2 lies in a longitudinal centre plane between the two grinding shoes 18.

Figure 4:
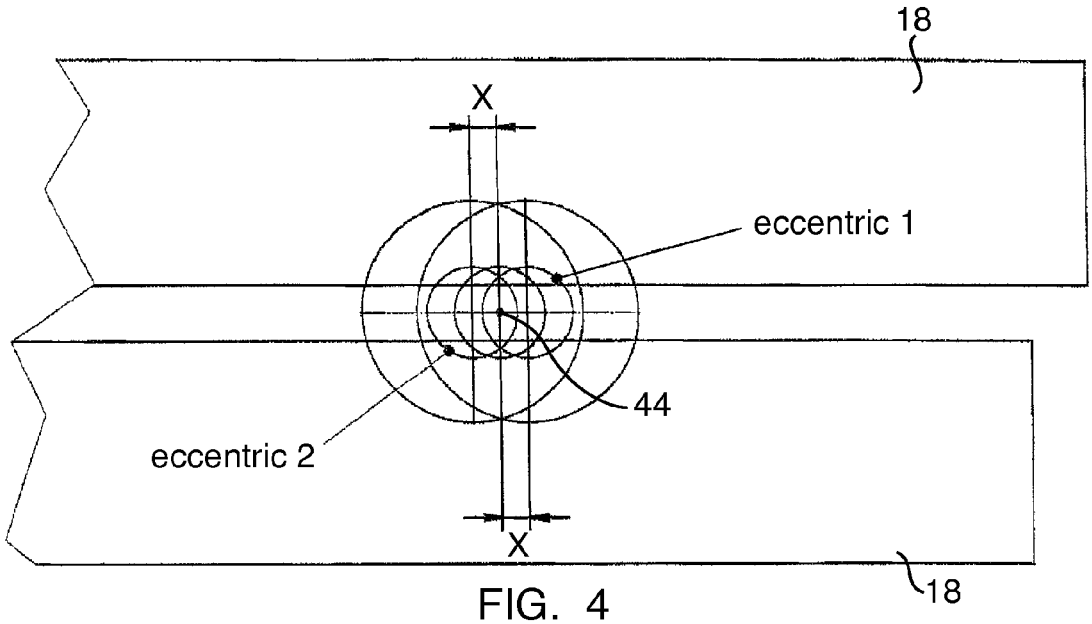

FIG. 4 shows the same arrangement after the shaft 26 has been rotated by 90°. The eccentricities X are now arranged in parallel to the longitudinal direction of the two grinding shoes 18. When comparing the FIGS. 3 and 4 one notes that the two grinding shoes 18 have on the one hand moved closer together and on the other hand are displaced from each other in the longitudinal direction.

Figure 5:
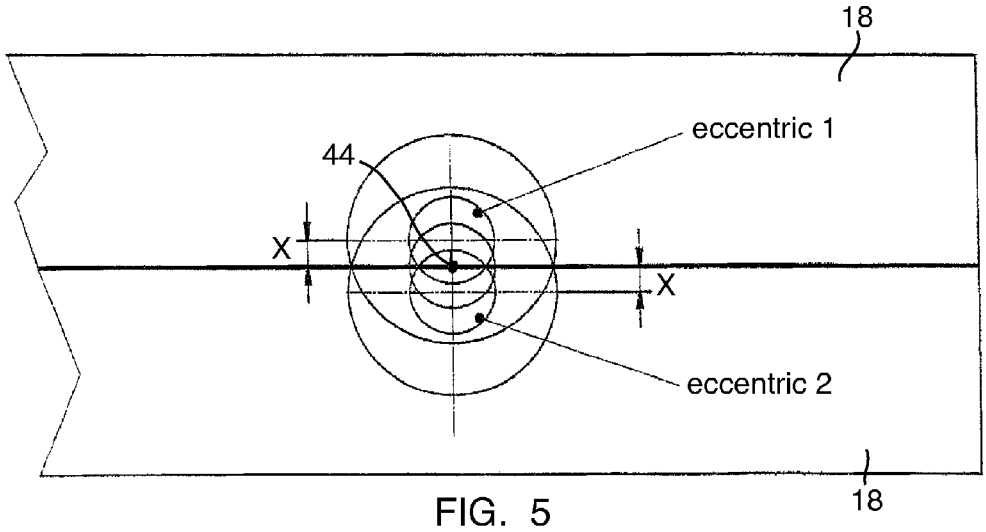

Finally, FIG. 5 shows the arrangement of the two grinding shoes after the drive shaft 26 has been rotated by a further 90°, i.e. by 180° with respect to the position shown in FIG. 3. The two grinding shoes 18 are now in a position closest to each other whereby they are again at the same height when viewed in the longitudinal direction.

The two grinding shoes 18 perform identical circular rotary movements in opposite directions in a plane parallel to the work piece support surface 12. Combined with the fact that the work piece 14 passes the two grinding shoes 18 in sequence while they are in motion and that there is no compulsory ratio between the feed rate of the work piece 14 and the circular motion of the two grinding shoes 18, an irregular overlapping of the grinding marks produced by two grinding shoes 18 occurs on the work piece surface so that a high-quality grinding result is achieved. In contrast to the embodiment described in the European patent specification 543 947 mentioned above, the construction of the grinding machine according to the invention is considerably more simple and it allows for an at least almost perfect weight balance during the operation of the grinding machine.

Figure 6:
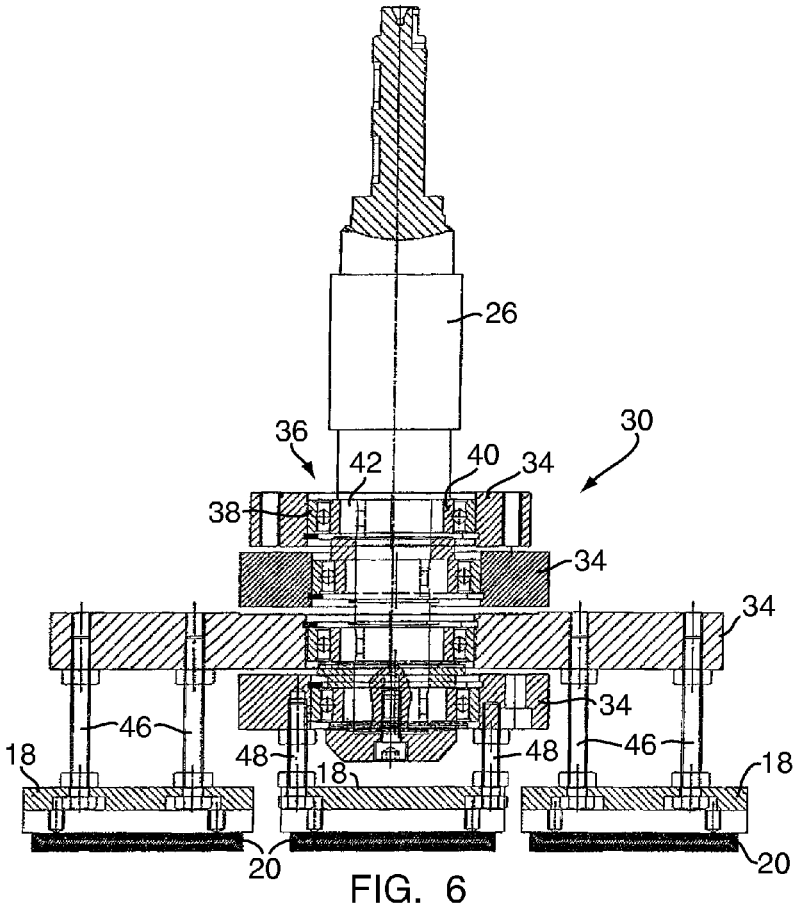
FIG. 6 shows a partial section corresponding to FIG. 2 according to a second exemplary embodiment of the invention with three grinding shoes arranged side by side.

FIG. 6 shows a depiction corresponding to FIG. 2 of a second embodiment of the invention wherein the same parts are denoted by the same reference numbers and will not be described again. The embodiment according to FIG. 6 differs from the one according to the FIGS. 1 to 5 in that the grinding bar 16 does not contain two but three grinding shoes 18 which are arranged in parallel and side by side. The two outer grinding shoes are connected via bolts 46 to a common elongated arm 34' and are connected rigidly to each other via this arm 34' so that they move in unison. The elongated arm 34' is rigidly connected to the topmost arm 34 of the eccentric arrangement 30 in a manner not shown in the drawing, so that the two outer grinding shoes 18 are mounted eccentrically at two points on the drive shaft or eccentric shaft 26, as is already the case with each grinding shoe of the embodiment according to FIGS. 1 to 5.

The middle grinding shoe 18 is fixed to the lowest arm 34 via bolts 48 and mounted eccentrically on the drive shaft 26 via this arm. This lowest arm 34 is rigidly connected with the arm 34 arranged on the other side of the elongated arm 34' in a manner not shown in the drawing, so that also the middle grinding shoe 18 is mounted again at two points on the drive shaft 26.

The outer grinding shoes 18 and the middle grinding shoe 18 each have the same mass. The overall arrangement formed by the two outer grinding shoes 18 therefore has twice the mass of the middle grinding shoe 18 alone. In order to balance the centrifugal forces in this arrangement, the eccentricity Y of the eccentric bushings 42 for the middle grinding shoe 18 is twice as big as the eccentricity X of the eccentric bushings 42 and is displaced by 180° with respect to the eccentricity X. In a practical embodiment the value of X is 1 mm and the value of Y is 2 mm. Apart from this, however, the arrangement according to FIG. 6 works in the same manner as the one according to FIGS. 1 to 5. During one rotation, out of its middle position shown in FIG. 6, the middle grinding shoe 18 once approaches the right grinding shoe 18 and once approaches the left grinding shoe 18 of the arrangement formed by the two outer grinding shoes.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A grinding machine, containing a machine frame with a work piece support surface and at least one grinding bar moveably mounted on the machine frame and extending transversely across the work piece support surface, which grinding bar carries a grinding medium on its surface facing the work piece support surface and which grinding bar can be driven by means of an eccentric drive in a circular movement parallel to the work piece support surface in such a way that it travels in circles parallel to itself, the eccentric drive having at least two eccentric shafts directed perpendicularly with regard to the work piece support surface and distanced from each other in the longitudinal direction of the grinding bar, wherein the grinding bar is divided into at least two parallel grinding shoes arranged side by side, which are each driveably by the eccentric shafts of the eccentric drive, wherein the eccentricities (X, Y) of the eccentrics assigned to the single grinding shoes and the masses of the grinding shoes are selected such that the centrifugal forces caused by the driven grinding shoes balance each other, wherein each grinding shoe is mounted on each eccentric shaft by at least two arms, and wherein the arms of the at least two grinding shoes are arranged in alternating order on top of one another on each of the eccentric shafts.

2. The grinding machine according to claim 1, wherein the grinding bar contains two grinding shoes of equal mass and that the eccentricities (X) of the eccentrics assigned to the two grinding shoes are of equal size but displaced from each other by 180° with respect to the drive axes.

3. The grinding machine according to claim 1, wherein the grinding bar contains three grinding shoes of equal mass, wherein the two outer ones are rigidly connected to each other so that they move in unison and in that the eccentricity (Y) of the eccentrics assigned to the middle grinding shoe is twice as big as the eccentricity (X) of the eccentrics assigned to the outer grinding shoes and displaced by 180° with respect to them.

* * * * *